United States Patent [19]

Voelz et al.

[11] 4,202,385

[45] May 13, 1980

[54] LIQUID DISPENSING, VAPOR RECOVERY SYSTEM

[75] Inventors: Frederick L. Voelz, Orland Park; Roy G. Jewell, Country Club Hills, both of Ill.

[73] Assignee: Atlantic Richfield Company, Philadelphia, Pa.

[21] Appl. No.: 877,645

[22] Filed: Feb. 14, 1978

[51] Int. Cl.[2] ..... B65B 31/00

[52] U.S. Cl. ..... 141/59; 141/DIG. 1; 417/420

[58] Field of Search ..... 141/52, 59, 97, 290, 141/392, 192, DIG. 1; 417/420

[56] References Cited

U.S. PATENT DOCUMENTS

| | | | |
|---|---|---|---|
| 3,016,928 | 1/1962 | Brandt | 141/290 X |
| 3,860,064 | 1/1975 | Murphy | 417/420 X |
| 4,068,687 | 1/1978 | Long | 141/290 X |

*Primary Examiner*—Frederick R. Schmidt

*Attorney, Agent, or Firm*—Stanley M. Welsh

[57] ABSTRACT

An improved, hybrid liquid dispensing, vapor recovery system is disclosed. As preferred, a turbine thereof is mounted in a liquid dispensing line, and an impeller thereof is mounted in a vapor recovery line and magnetically coupled with the turbine. The apparatus responds to the rate at which liquid is dispensed, and thereby controls vapor leaks in liquid receivers.

11 Claims, 2 Drawing Figures

LIQUID DISPENSING, VAPOR RECOVERY SYSTEM

BACKGROUND OF THE INVENTION

This invention relates to a liquid dispensing, vapor controlling system and more particularly, to an improved, hybrid liquid dispensing, vapor recovery system and vapor collecting apparatus.

Hydrocarbon burning vehicles, e.g., automobiles, typically have their fuel tanks intermittently filled from stationary storage tanks from which liquid hydrocarbon fuel, e.g., gasoline, is dispensed through fuel dispensing nozzles during filling, or fuel dispensing operations. In the past, hydrocarbon vapors displaced from the fuel tank by the entering liquid fuel have been allowed to escape out the fuel tank inlet or fillpipe. However, various governmental regulations have been promulgated to require that the escaping vapor be controlled, and the State of California, California Air Resources Board, requires that liquid hydrocarbon fuel dispensing, vapor controlling systems be certified before being installed in that state. Currently available are several systems classifiable in three categories: secondary, vapor balance and hybrid. Secondary systems include those systems which employ a vacuum pump in a vapor control line to create a suction at the vehicle fillpipe/dispensing nozzle interface. Vapor balance systems include those which rely upon the pressure difference developed between the vapor space of the vehicle fuel tank and the vapor space of the storage tank as fuel is dispensed to the fuel tank. Hybrid systems include those which combine features of the secondary and vapor balance systems.

While the vapor recovery systems now certified for use in California have been somewhat useful, certain advantages remain unattained thereby. For example, a certified secondary system creates such an intense vacuum at the fillpipe/nozzle interface that large quantities of air are ingested from the environment into the vapor control line. As a result, the mixture of vapor and air could come within or near the explosive mixture limits of the fuel, thereby creating a risk of explosion. Also, a great proportion of the mixture of vapor and air must be incinerated, because the mixture cannot be returned to the storage tank without excessive pressurization thereof. The system with its incinerator is costly to produce, requires periodic maintenance by a skilled technician and tends toward high maintenance and operation costs.

As for the only hybrid system known to be certified, that system diverts about twenty percent of the fuel being dispensed away from the dispensing nozzle through an aspirator which pulls the vapor from the fuel tank. The diverted fuel and the vapor pass through a return line into the vapor space of the storage tank. Because twenty percent of the fuel is diverted, a significant increase in power consumption results. Also, because the system recirculates fuel to the vapor space of the storage tank, it encourages vapor growth therein.

Finally, a vapor balance system may require the maintenance of a tight seal at the fillpipe/nozzle interface.

SUMMARY OF THE INVENTION

It is thus an object of the present invention to provide a liquid dispensing, vapor controlling system which attains the advantages as yet unattained by prior art systems.

Specifically, it is an object of the present invention to provide a liquid, e.g., hydrocarbon fuel, dispensing, vapor controlling system and vapor controlling apparatus therefor which does not ingest substantial quantities of air into the vapor control line, thereby keeping the mixture of vapor and ingested air away from the explosive mixture limits, and permitting the return of substantially all the vapor to the fuel storage tank.

Another object of the present invention is to provide a system and apparatus which can function without the maintenance of a tight seal at the automobile fuel tank fillpipe/nozzle interface to control vapor displaced from the fuel tank.

Still another object of the present invention is to provide a system and apparatus which reduces vapor loss through external vents on the fuel tanks of vehicles, such as those automobiles built prior to 1970.

A further object of the present invention is to provide a system and apparatus which do not block the vapor return line in case of system failure.

A still further object of the present invention is to provide a system and apparatus which are mechanically and electrically streamlined over prior art systems and apparatus, thereby resulting in reduced production, maintenance and operational costs.

Yet another object of the present invention is to provide a system and apparatus which consume less energy than prior art systems.

These and other objects and advantages are attainable by the present invention, which in a principal aspect, is an improved liquid dispensing, vapor recovery system. The system is utilized in association with a liquid source and a liquid receiver and includes a liquid dispensing subsystem having a liquid dispensing line for intermittently delivering liquid from the liquid source to the liquid receiver. The system further includes a vapor recovery subsystem having a mechanism for collecting vapor displaced from the liquid receiver. The collector mechanism is mounted in association with the dispensing subsystem for collecting vapor whenever the dispensing subsystem delivers liquid to the liquid receiver. The vapor recovery subsystem includes also a recovery line in vapor communication with the vapor space of the liquid source and with the collector mechanism; a mechanism mounted in the recovery line for impelling vapor therein toward the liquid source; and a driving mechansim for driving the impelling mechanism, the driving mechanism operatively connected to the impelling mechanism and mounted in the dispensing line for generating kinetic energy from the flow of liquid in the dispensing line.

As preferred, the impelling mechanism is a blower of a type which does not cause substantial compression of the vapors, or create a substantial vacuum upstream of itself in the vapor return line, when a tight seal is obtained at the liquid receiver/collector mechanism interface. Also as preferred, the driving mechanism is a turbine rotatably mounted in the dispensing line and magnetically coupled to the blower.

With the system as thus described, the advantages unattained with prior art devices are now attained. For example, since the blower is powered by a turbine which takes energy from the flowing fuel, no external source of power is required for the operation of the system, other than the fuel pump. Further, since the rotational velocity of the turbine is a direct function of the rate at which liquid is dispensed, the rotational velocity of the blower is also a direct function of the dispensing rate. Consequently, the system is sensitive to the rate at which vapors are discharged from the tank, since increased liquid flow into the tank will result in an increased vapor discharge from the tank.

When used to recover vapor from a liquid receiver having no vents and against which a substantially vapor-tight seal at the liquid receiver/collector mechanism interface is maintained, the system does not substantially compress the escaping vapors and therefore does not create a danger of explosion. When used with a liquid receiver which has a vapor leak caused by a vent or a loose seal at the liquid receiver/collector mechanism interface, however, the system responds to the size of the leak by creating a vapor flow sufficient to control the leak. Finally, when inoperative, the system reverts to a liquid dispensing, vapor balance, vapor recovery system, since the blower does not block the vapor return line.

The stated objects and advantages, plus other significant objects and advantages, will become apparent from a reading of the description of the preferred embodiment of the invention, which follows.

BRIEF DESCRIPTION OF THE DRAWING

The preferred embodiment of the present invention will be described in relation to the accompanying drawing wherein.

DETAILED DESCRIPTION OF THE PREFERRED EMBODIMENT

The present invention and the preferred embodiment thereof are considered to be suitable for dispensing a variety of liquids into liquid receivers and recovering vapors displaced therefrom. However, because the present invention is particularly suitable for utilization as a system for dispensing liquid hydrocarbon fuel and recovering hydrocarbon vapors, the preferred embodiment will be described with reference to such a utilization.

Figure 1:
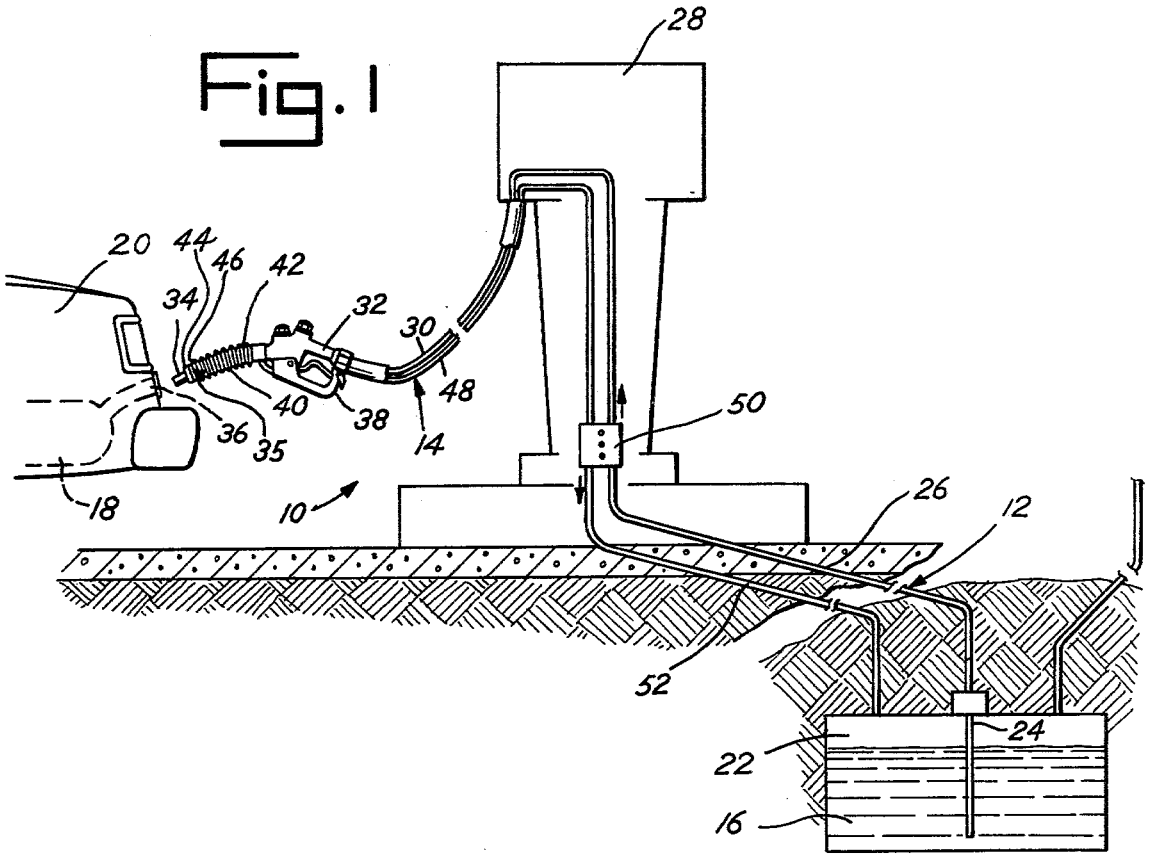
FIG. 1 is a view of the preferred embodiment of a liquid hydrocarbon fuel dispensing, hydrocarbon vapor controlling system.

Referring to FIG. 1, the preferred embodiment of the present invention is depicted therein and generally designated as a system 10. Briefly, the system 10 includes a fuel dispensing subsystem 12 and a vapor recovery subsystem 14. The system 10 is utilized to dispense liquid hydrocarbon fuel from a source such as an underground storage tank 16 to the fuel tank 18 of an automobile 20, and to return vapors displaced therefrom to the vapor space 22 of the storage tank 16.

More specifically, the subsystem 12 includes a fuel propelling mechanism such as a fuel propelling turbine 24. Mounted within the underground storage tank 16, the fuel propelling turbine 24 propels fuel upward through the first fuel dispensing line or conduit 26 to an above-ground dispenser 28. From there, the fuel is delivered through a second fuel dispensing line or hose 30 to a dispensing nozzle 32.

As shown, the nozzle 32 has a spout 34 which may be placed in the fuel tank inlet or fillpipe 36 of the automobile 20. To automatically retain the spout 34 therein, the nozzle 32 includes a latch mechanism 35. As conventional, the dispenser 28 has mounted thereon a main electrical switch (not shown) which must be manually tripped to energize the fuel propelling turbine 24. In addition, operably connected to the latch mechanism 35 is a second switch (not shown) which automatically prevents the fuel from passing through the nozzle 32 unless the spout 34 is properly placed and latched within the fillpipe 36.

Gasoline is thus delivered to the fuel tank 18 by the subsystem 12. The rate at which gasoline is dispensed from the spout 34 is controlled by manually squeezing the nozzle handle 38. A range of fuel flow rates may thus be obtained, preferably in a range of about 3 gallons per minute to about 15 gallons per minute, for example, about eight gallons per minute.

Referring again to FIG. 1, the vapor recovery subsystem 14 includes a vapor collecting mechanism such as the flexible bellows 40. Mounted at a fixed end 42 to the nozzle 32, the bellows 40 encircles the spout 34. An annular face plate 44 is attached to the free end 46 of the bellows 40. When the spout 34 is placed in the fillpipe 36, the bellows 40 flexes to resiliently maintain a substantially vapor-tight seal between the face plate 44 and the upper end of the inlet 36. Thus when fuel is dispensed into the fuel tank 18, vapors displaced therefrom out the inlet 36 are collected or captured in the bellows 40 and prevented from escaping to the environment.

The vapor recovery subsystem 14 further includes a first vapor return line or hose 48 in vapor connunication with the bellows 40 and with a vapor impeller apparatus 50. A second vapor return line or conduit 52 extends from the vapor impeller apparatus 50 to the vapor space 22, and is in communication therewith. The vapor impeller apparatus 50 impels the vapor toward the vapor space 22 and thus vapor collected in the bellows 40 is routed to and placed in the storage tank 16.

Figure 2:
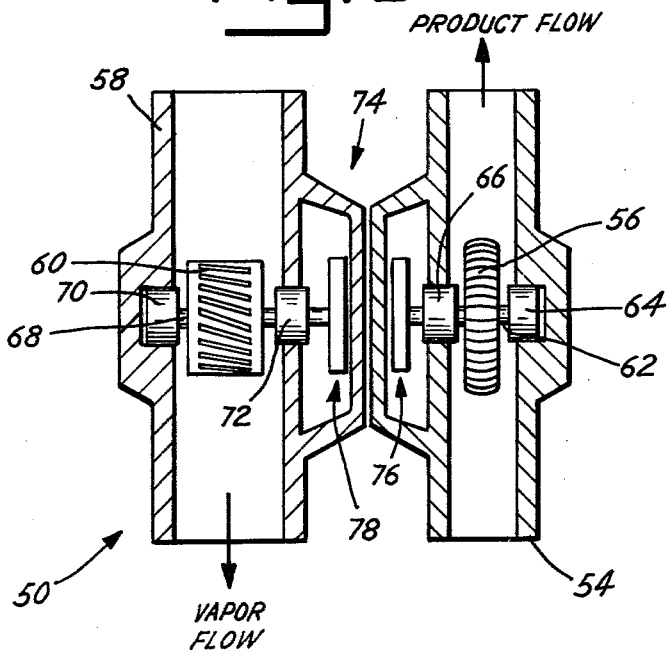
FIG. 2 is a cross section view of the vapor controlling apparatus of the preferred embodiment of FIG. 1.

As shown in FIG. 2, the vapor impeller apparatus 50 preferably includes a first impeller conduit 54 containing a turbine 56 and a second impeller conduit 58 containing an impeller or blower 60. As will be detailed, the turbine 56 is driven by the flow of fuel in the dispensing subsystem 12 and the turbine 56 and blower 60 are operably connected so that kinetic energy generated by the turbine 56 drives the blower 60.

That is, the turbine 56 is mounted within the first impeller conduit 54 on a first axle 62 that is rotatably mounted upon bearings 64,66. The first impeller conduit 54 is mounted within the dispenser 28, in communication with and between the dispensing lines 26,30. The flow of fuel in lines 26,30 thus rotates the turbine 56, and the rotational velocity thereof increases and decreases in proportion to increases and decreases in the fuel flow rate. The higher the fuel flow rate, the more rapidly turbine 56 rotates.

Mounted within the second impeller conduit 58 on a second shaft or axle 68, which is co-axially aligned with the first axle 62, is the blower 60. The second axle 68 is rotatably mounted upon bearings 70,72, and the second impeller conduit 58 is mounted within the dispenser 28 in communication with and between the vapor return lines 48,52. Thus, the blower 60 may be rotated to impel vapors toward the vapor space 22. As shown, the blower 60 is preferably a "squirrel cage" type which will not cause substantial compression of the vapors, or create a substantial vacuum if the fuel tank 18 is sealed substantially tight against vapor release. A blower 60 of the squirrel cage-type will, however, create a vapor flow if the fuel tank 18 is not sealed, and the amount of vapor flow will increase as the size of any vapor leaks increases.

Operably connecting the blower 60 and the turbine 56 is a magnetic coupling referred to generally as magnetic coupling 74. A first magnetic member 76 thereof is mounted on an axial extension of the first axle 62 and a second magnetic member 78 thereof is mounted on an axial extension of the second axle 68. The magnetic members 76,78 are adjacent one another, within a distance such that the magnetic fields thereof interact or couple. Consequently, the flow of fluid in the dispensing subsystem 12 powers the blower 60. That is, the flow of fuel through the first impeller conduit 54 rotates the turbine 56, thereby rotating the first axle 62 and the first magnetic member 76. The interaction of magnetic fields between the magnetic members 76,78 causes the second magnetic member 78 to rotate, thereby rotating the second axle 68 and the blower 60.

Because the rotational velocity of the turbine 56 varies in proportion to the fuel flow rate, and because the rotational velocity of the second magnetic member 78 varies in proportion to the rotational velocity of the first magnetic member 76, over a desired range of velocities the rotational velocity of the blower 60 varies in proportion to the rate at which fuel is dispensed to, and vapor is displaced from, the fuel tank 18.

As shown in FIG. 2, the magnetic members 76,78 need not be physically connected. The first impeller conduit 54 and the dispensing lines 26,30 may be physically isolated from the second impeller conduit 58 and the vapor recovery lines 48,52. The introduction of liquid fuel into the vapor recovery lines 48,52 is prevented, and the safety of the system 10 increased.

From the foregoing, it should be apparent to those having average skill in the art that the system 10 as described herein could be modified and the present invention embodied in alternative equivalent forms. Accordingly, the preferred embodiment should be considered as illustrative and not restrictive, the scope of the claimed invention being measured by the following claims.

What is claimed is:

1. An improved hybrid liquid dispensing, vapor recovery system for utilization in association with a liquid source and a liquid receiver, said system comprising, in combination:

a liquid dispensing subsystem having a liquid dispensing line for intermittently delivering liquid from said liquid source through said dispensing line to said liquid receiver; and a vapor recovery subsystem including, a collector means for collecting vapor from said liquid receiver, said collector means mounted in association with said dispensing subsystem for collecting vapor whenever said dispensing subsystem delivers liquid to said liquid receiver, a recovery line in vapor communication with a vapor space of said liquid source and with said collector means, means mounted on a first shaft transverse to a passageway in vapor communication with said recovery line for impelling the vapor in said recovery line toward said liquid source, and means for driving said impelling means, said driving means operably connected by means of a magnetic coupling to said impelling means and mounted on a second shaft in a passageway in communication with said dispensing line for generating kinetic energy from the flow of liquid in said dispensing line.

2. A system as claimed in claim 1 wherein the driving energy generated by said driving means is functionally related to the rate of flow of liquid in said dispensing line.

3. A system as claimed in claim 1 wherein the driving energy generated by said generating means varies in proportion to the rate of flow of liquid in said dispensing line.

4. A system as claimed in claim 1 wherein the driving means includes turbine means mounted in said dispensing line.

5. A system as claimed in claim 1 wherein the impelling means includes blower means mounted in said vapor recovery line.

6. A system as claimed in claim 1 wherein the driving means includes a turbine rotatably mounted in said dispensing line for generating said driving energy by rotating in response to the flow of liquid in said dispensing line.

7. A system as claimed in claim 6 wherein the impelling means includes a squirrel cagetype blower rotatably mounted in said vapor recovery line for rotating in response to the energy generated by said driving means.

8. A system as claimed in claim 7 wherein said blower and said turbine are operably connected so that rotation of said turbine results in rotation of said blower.

9. A vapor recovery system as claimed in claim 7 further comprising a magnetic coupling for operably connecting said turbine and said blower so that rotation of said turbine results in rotation of said blower.

10. A vapor recovery system as claimed in claim 6 wherein said blower is adapted to permit vapor to move along said vapor return line when said blower is inoperative.

11. Vapor impeller apparatus for utilization in association with a liquid dispensing line and a vapor collecting line to collect vapor from a liquid receiver as liquid is delivered thereto, said apparatus comprising, in combination:

a first impeller conduit defining a first passageway adapted to be placed in communication with said liquid dispensing line;

a second impeller conduit defining a second passageway adapted to be placed in vapor communication with said vapor collecting line;

said first impeller conduit and said second impeller conduit being physically separated so that liquid in said first impeller conduit cannot enter said second impeller conduit;

a first shaft rotatably mounted transverse to said first impeller conduit within said first passageway;

a turbine mounted on said first shaft for rotation therewith in response to the flow of liquid in said first passageway, the rotational velocity of said turbine varying with the rate of flow of said liquid;

a first magnetic member mounted on said first shaft for rotation therewith;

a second shaft rotatably mounted transverse to said second conduit within said second passageway, said second shaft co-axially aligned with said first shaft;

an impeller mounted on said second shaft for rotation therewith, said impeller creating a vapor flow in said second passageway as a result of rotation thereof, said vapor flow varying with the rotational velocity of said impeller; and a second magnetic member mounted on said second shaft for rotation therewith;

said first magnetic member and said second magnetic member adjacent one another and magnetically coupled so that rotation of said first magnetic member results in rotation of said second magnetic member, the rotational velocity of said second magnetic member and thereby said impeller varying with the rotational velocity of said first magnetic member and thereby said turbine.

* * * * *